US011217923B2

(12) United States Patent
Wang et al.

(10) Patent No.: US 11,217,923 B2
(45) Date of Patent: Jan. 4, 2022

(54) PLUG-IN STRUCTURE, CONNECTOR, PLUG, AND PLUG-IN METHOD THEREOF

(71) Applicants: Chengdu BOE Optoelectronics Technology Co., Ltd., Sichuan (CN); BOE Technology Group Co., Ltd., Beijing (CN)

(72) Inventors: Kang Wang, Beijing (CN); Jiaxiang Zhang, Beijing (CN); Junhui Yang, Beijing (CN); Haotian Yang, Beijing (CN); Xiaoxia Liu, Beijing (CN); Fuzheng Xie, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/915,022

(22) Filed: Jun. 29, 2020

(65) Prior Publication Data

US 2020/0412043 A1 Dec. 31, 2020

(30) Foreign Application Priority Data

Jun. 28, 2019 (CN) ..... 201910579830.7

(51) Int. Cl.
*H01R 12/78* (2011.01)
*H01R 13/631* (2006.01)

(52) U.S. Cl.
CPC ..... *H01R 12/78* (2013.01); *H01R 13/631* (2013.01)

(58) Field of Classification Search
CPC ..... H01R 12/78; H01R 13/631
See application file for complete search history.

(56) References Cited

U.S. PATENT DOCUMENTS

| | | | | |
|---|---|---|---|---|
| 10,694,628 | B2 * | 6/2020 | Xu | G09F 9/00 |
| 10,833,439 | B2 * | 11/2020 | Wang | H01R 12/79 |
| 11,005,199 | B2 * | 5/2021 | Hou | H01R 12/73 |
| 2019/0074616 | A1 * | 3/2019 | Hou | H01R 12/585 |

FOREIGN PATENT DOCUMENTS

| | | | |
|---|---|---|---|
| CN | 101950865 | A * | 1/2011 |
| CN | 101950865 | A | 1/2011 |
| CN | 202042639 | U | 11/2011 |
| CN | 102916268 | A | 2/2013 |
| CN | 103151647 | A | 6/2013 |
| CN | 205944499 | U | 2/2017 |

OTHER PUBLICATIONS

First office action of Chinese application No. 201910579830.7 dated Apr. 21, 2020.

* cited by examiner

*Primary Examiner* — Abdullah A Riyami
*Assistant Examiner* — Nader J Alhawamdeh
(74) *Attorney, Agent, or Firm* — Fay Sharpe LLP

(57) ABSTRACT

A plug-in structure includes a connector and a plug; wherein the connector is provided with a jack. The jack is provided with a first terminal and a first guide rail structure are arranged, the first terminal being configured to be electrically connected to a first flexible circuit board; and the plug is provided with a second terminal and a second guide rail structure, the second terminal being configured to be electrically connected to a second flexible circuit board, and the second guide rail structure of the plug being in cooperation with the first guide rail structure in the jack to guide the plug to move in the jack, such that the first terminal and the second terminal are electrically connected.

18 Claims, 3 Drawing Sheets

PLUG-IN STRUCTURE, CONNECTOR, PLUG, AND PLUG-IN METHOD THEREOF

CROSS REFERENCE TO RELATED APPLICATION

This application claims priority to Chinese Patent Application No. 201910579830.7, filed on Jun. 28, 2019 and titled "PLUG-IN STRUCTURE, CONNECTOR, PLUG, AND PLUG-IN METHOD THEREOF", the entire contents of which are incorporated herein by reference.

TECHNICAL FIELD

The present disclosure relates to the field of electrical devices, and more particularly to a plug-in structure, a connector, a plug, and a plug-in method thereof.

BACKGROUND

At present, flexible circuit boards are usually connected by a connector and a plug.

The connector is electrically connected to one flexible circuit board, and the plug is electrically connected to the other flexible circuit board. When connecting the connector and the plug, generally, an operator uses tweezers to clamp a position of the flexible circuit board proximal to the plug, and the plug is plugged into a jack of the connector after the plug is aligned with the jack of the connector, such that the plug is plugged into the connector.

SUMMARY

The present disclosure provides a plug-in structure, a connector, a plug, and a plug-in method.

In a first aspect, a plug-in structure is provided. The plug-in structure includes a connector and a plug. The connector is provided with a jack; wherein the jack is provided with a first terminal and a first guide rail structure, the first terminal is configured to be electrically connected to a first flexible circuit board; and the plug is provided with a second terminal and a second guide rail structure; wherein the second terminal is configured to be electrically connected to a second flexible circuit board, and the second guide rail structure of the plug is in cooperation with the first guide rail structure in the jack to guide the plug to move in the jack, such that the first terminal is electrically connected to the second terminal.

Optionally, the first guide rail structure includes a strip-shaped protrusion, and the second guide rail structure includes a strip-shaped groove.

Optionally, corners of both the strip-shaped protrusion and the strip-shaped groove are chamfered.

Optionally, the jack is a square hole enclosed by two opposite side surfaces and two opposite bottom surfaces.

Optionally, the first guide rail structure is disposed on the two side surfaces.

Optionally, the plug includes a substrate layer; wherein the substrate layer is enclosed by a first surface and a second surface opposite to each other as well as a side surface connected to both the first surface and the second surface; the second terminal is disposed on the first surface; and the second guide rail structure is disposed on the side surface.

Optionally, the first guide rail structure is disposed on one of the two bottom surfaces.

Optionally, the plug includes a substrate layer; wherein the substrate layer is enclosed by a first surface and a second surface opposite to each other as well as a side surface connected to both the first surface and the second surface; the second terminal is disposed on the first surface; and the second guide rail structure is disposed on the second surface.

Optionally, a material of the substrate layer includes polyimide.

Optionally, a material of the strip-shaped protrusion includes polyterephthalate plastic.

In another aspect, a plug-in method of the above plug-in structure is provided. The method includes:

aligning a plug with a jack of a connector, and enabling a second guide rail structure of the plug to be in cooperation with a first guide rail structure in the jack; and plugging the plug into the jack under guidance of the first guide rail structure and the second guide rail structure that are in cooperation with each other, such that the second terminal on the plug is electrically connected to the first terminal in the jack.

In another aspect, a connector is provided. The connector is provided with a jack. The jack is provided with a first terminal and a first guide rail structure; wherein the first terminal is configured to be electrically connected to a first flexible circuit board.

In another aspect, a plug is provided. The plug is provided with a second terminal and a second guide rail structure; wherein the second terminal is configured to be electrically connected to a second flexible circuit board.

Optionally, the first guide rail structure includes a strip-shaped groove, and the second guide rail structure includes a strip-shaped protrusion.

Optionally, corners of both the strip-shaped protrusion and the strip-shaped groove are rounded.

Optionally, a material of the substrate layer includes polyimide.

Optionally, the first guide rail structure includes a strip-shaped protrusion, the second guide rail structure includes a strip-shaped groove; wherein corners of both the strip-shaped protrusion and the strip-shaped groove are rounded, and a material of the strip-shaped protrusion includes polyterephthalate plastic;

the jack is a square hole enclosed by two opposite side surfaces and two opposite bottom surfaces, and the first guide rail structure is disposed on the two side surfaces; and the plug includes a substrate layer; wherein the substrate layer is enclosed by a first surface and a second surface opposite to each other as well as a side surface connected to both the first surface and the second surface, the second terminal is disposed on the first surface, the second guide rail structure is disposed on the side surface, and a material of the substrate layer includes polyimide.

Optionally, the jack is a square hole enclosed by two opposite side surfaces and two opposite bottom surfaces, and the first guide rail structure is disposed on the two side surfaces.

Optionally, the plug includes a substrate layer; wherein the substrate layer is enclosed by a first surface and a second surface opposite to each other as well as a side surface connected to both the first surface and the second surface; the second terminal is disposed on the first surface; and the second guide rail structure is disposed on the side surface.

Optionally, the plug includes a substrate layer, and the substrate layer is enclosed by a first surface and a second surface opposite to each other as well as a side surface connected to both the first surface and the second surface;

the second terminal is disposed on the first surface; and the second guide rail structure is disposed on the second surface.

Figure 1:
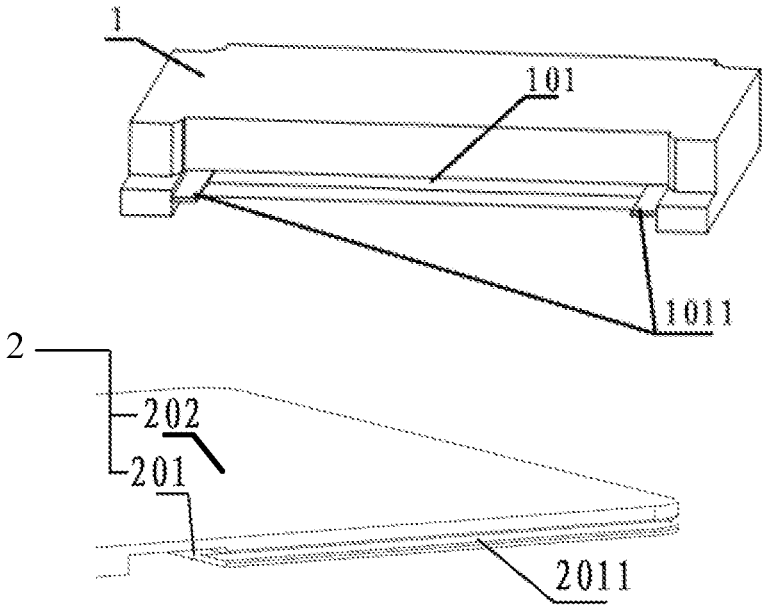
FIG. 1 is a schematic diagram of a plug-in structure according to an embodiment of the present disclosure in a separated state.

Reference numerals and denotations thereof:

1—connector;
101—jack;
1011—first guide rail structure;
2—plug;
201—substrate layer;
202—second terminal; and
2011—second guide rail structure.

DETAILED DESCRIPTION

Embodiments of the present disclosure are described hereinafter with reference to the drawings.

As known by the inventors, in order to achieve slimness of devices, a conventional portable device typically includes a plurality of flexible circuit boards. For example, an organic light-emitting diode (OLED) display device or a liquid crystal display (LCD) device generally includes at least two flexible circuit boards, namely, a touch flexible printed circuit board (TFPC) and a main flexible printed circuit board (MFPC). In a secondary assembling process, it is often necessary to establish an electrical connection between the two flexible circuit boards. The conventional flexible circuit boards are generally connected by a connector and a plug.

A connector according to the embodiments of the present disclosure may be a zero insertion force (ZIF) connector or a non-zero insertion force (non-ZIF) connector, and a plug in the embodiments of the present disclosure may be a connecting finger.

In the embodiments of the present disclosure, a plugging direction refers to a movement direction of a plug 2 relative to a connector 1 in a process that the plug 2 is plugged into a jack 101 of the connector 1.

An embodiment of the present disclosure provides a plug-in structure. As shown in FIG. 1, the plug-in structure includes a connector 1 and a plug 2.

The connector 1 is provided with a jack 101. The jack 101 is provided with a first terminal 102 and a first guide rail structure 1011 are arranged. The first terminal 102 is configured to be electrically connected to a first flexible circuit board 1012.

The plug 2 is provided with a second terminal 202 and a second guide rail structure 2011. The second terminal 202 is configured to be electrically connected to a second flexible circuit board 2012. The second guide rail structure 2011 of the plug 2 is in cooperation with the first guide rail structure 1011 in the jack 101 to guide movement of the plug 2 in the jack 101, such that the first terminal and the second terminal 202 are electrically connected. That is, the second guide rail structure 2011 is configured to be in cooperation with the first guide rail structure 1011 in a process of plugging of the plug 2 into the jack 101 of the connector 1, and the first terminal and the second terminal 202 are electrically connected after the plug 2 is plugged into the jack 101 of the connector 1.

The beneficial effects achieved the technical solutions according to the embodiments of the present disclosure at least are described as follows.

The plug-in structure according to the embodiment of the present disclosure includes the connector and the plug, wherein the connector is provided with the jack, the jack is provided with the first terminal and the first guide rail structure, and the first terminal may be electrically connected to the first flexible circuit board. The plug is provided with the second terminal and the second guide rail structure. The second terminal 202 may be electrically connected to the second flexible circuit board. As long as the plug is partially plugged into the connector, the second guide rail structure of the plug may be in cooperation with the first guide rail structure in the jack to guide the plug to continue to be plugged into the jack, such that the plug is smoothly plugged into the jack of the connector and thus the first flexible circuit board is in communication with the second flexible circuit board. In this way, damages caused by a clamping tool (such as tweezers) to the flexible circuit boards are prevented.

As shown in FIG. 1, the plug-in structure in FIG. 1 is in a separated state where the plug is not completely plugged into the connector and the first flexible circuit board and the second flexible circuit board are not conducted.

The connector 1 is provided with the jack 101 in which the first terminal (not shown in the figure) and the first guide rail structure 1011 are arranged; and the first terminal is configured to be electrically connected to the first flexible circuit board, and may a single-row terminal or a double-row terminal.

The plug 2 includes a substrate layer 201. The substrate layer 201 is enclosed by a first surface and a second surface (the first surface and the second surface may be the upper surface and the lower surface of the substrate layer 201 shown in FIG. 1, respectively) opposite to each other as well as a side surface connected to both the first surface and the second surface. The second terminal 202 is disposed on the first surface. The second guide rail structure 2011 is disposed on the side surface. The second terminal 202 is a single-row terminal or a double-row terminal. The first surface and the second surface of the substrate layer may be two identical surfaces at different positions, and the surface where the second terminal is disposed may be the first surface.

As an optional implementation, a material of the substrate layer 201 includes polyimide, and the substrate layer 201 overlaps with the second terminal 202. The substrate layer 201 is configured to increase the thickness and strength of the plug 2 to facilitate plugging.

Figure 2:
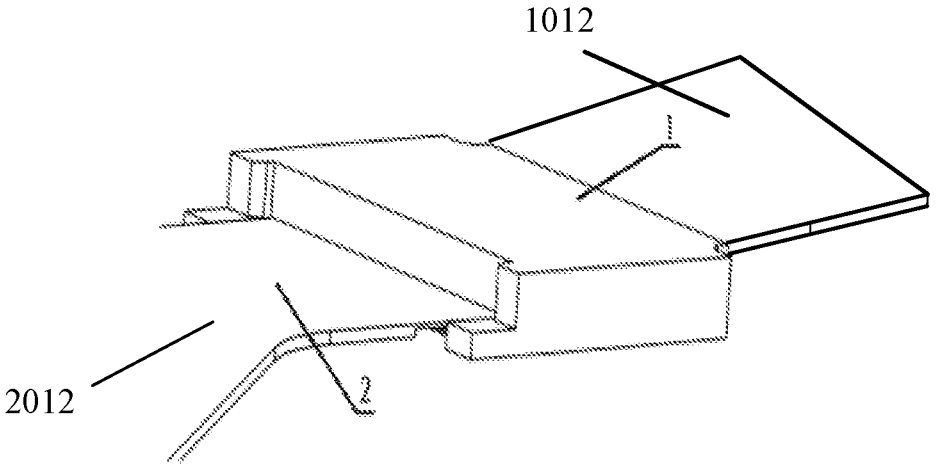
FIG. 2 is a schematic diagram of the plug-in structure according to the embodiment of the present disclosure in a plug-in completed state.

The second terminal 202 is configured to be electrically connected to a second flexible circuit board. The second guide rail structure 2011 is configured to be in cooperation with the first guide rail structure 1011 in a process of plugging of the plug 2 into the jack 101 of the connector 1, and the first terminal and the second terminal 202 are electrically connected after the plug 2 is plugged into the jack 101 of the connector 1. FIG. 2 shows a schematic diagram of a structure when the plug 2 is plugged into the connector 1 in the plug-in structure shown in FIG. 1.

As the first terminal is electrically connected to the first flexible circuit board and the second terminal 202 is electrically connected to the second flexible circuit board, when the first terminal and the second terminal 202 are electrically connected, the first flexible circuit board and the second flexible circuit board are electrically connected. That is, an electrical connection between the first flexible circuit board and the second flexible circuit board is successfully established.

The structures of both the connector 1 and the plug 2 are introduced below.

As an optional implementation, the jack 101 is a square hole enclosed by two opposite side surfaces and two opposite bottom surfaces.

It may be understood that the two side surfaces and the two opposite bottom surfaces are the inner surfaces of the jack 101.

The first terminal is disposed inside the jack 101 of the connector 1, and is disposed on one of the bottom surfaces (such as the upper bottom surface or the lower bottom surface in FIG. 1) inside the jack 101.

In the present embodiment, there are two position arrangements for the first guide rail structure 1011 and the second guide rail structure 2011 as follows.

In the first alternative guide rail position arrangement, the first guide rail structure 1011 is disposed on the two side surfaces which refer to the two side surfaces of the jack 101 herein.

Correspondingly, the second guide rail structure 2011 is disposed on the side surfaces of the substrate layer 201.

In this arrangement, the first guide rail structure 1011 is disposed on the two side surfaces of the jack 101 of the connector 1; the second guide rail structure 2011 is disposed on the two side surfaces of the substrate layer 201 of the plug 2; and the surfaces where the first guide rail structure 1011 is disposed correspond to the surfaces where the second guide rail structure 2011 is disposed, such that the positions of the first guide rail structure 1011 and the second guide rail structure 2011 may be in cooperation with each other.

Length directions of both the first guide rail structure 1011 and the second guide rail structure 2011 are parallel to the plugging direction.

In the second alternative guide rail position arrangement, the first guide rail structure 1011 is disposed on one of the two bottom surfaces.

As the first terminal is arranged on one bottom surface inside the jack 101, the first guide rail structure 1011 may be arranged on the other bottom surface in the two bottom surfaces inside the jack 101 of the connector 1 where the first terminal is not arranged.

The plug 2 includes a substrate layer 201. The substrate layer 201 is enclosed by a first surface and a second surface (the first surface and the second surface may be the upper surface and the lower surface of the substrate layer 201 shown in FIG. 1, respectively) opposite to each other as well as a side surface connected to both the first surface and the second surface. The second terminal 202 is disposed on the first surface. The second guide rail structure 2011 is disposed on the second surface opposite to the first surface where the second terminal 201 is disposed.

The substrate layer 201 overlaps with the second terminal 202. The substrate layer 201 is further provided with two surfaces (i.e., the first surface and the second surface) in addition to the side surface, wherein one surface (i.e., the first surface) faces the second terminal 202 and is connected to the second terminal 202, and the other surface (i.e., the second surface) faces away from the second terminal 202 and is opposite to the surface where the second terminal 202 is disposed. In this arrangement, the second guide rail structure 2011 is arranged on the surface of the substrate layer 201 opposite to the surface where the second terminal 202 is disposed.

In this arrangement, the first guide rail structure 1011 is disposed on one bottom surface of the jack 101 of the connector 1; the second guide rail structure 2011 is disposed on the other bottom surface of the substrate layer 201 of the plug 2 opposite to the surface where the second terminal 202 is disposed; and the surface where the first guide rail structure 1011 is disposed corresponds to the surface where the second guide rail structure 2011 is disposed, such that the positions of the first guide rail structure 1011 and the second guide rail structure 2011 may be in cooperation with each other.

Optionally, both the first guide rail structure 1011 and the second guide rail structure 2011 are parallel to the plugging direction.

Structures of both the first guide rail structure 1011 and the second guide rail structure 2011 are suitable for cooperation with each other, and specific mutual cooperation may include the followings.

In the first optional implementation, as shown in FIG. 1, the first guide rail structure 1011 includes a strip-shaped protrusion, and the second guide rail structure 2011 includes a strip-shaped groove. Structures of both the strip-shaped protrusion and the strip-shaped groove are suitable for cooperation with each other. That is, the strip-shaped protrusion of the first guide rail structure 1011 may be plugged into the strip-shaped groove of the second guide rail structure 2011. The structures of both the strip-shaped protrusion and the strip-shaped groove are relatively simple and easy to manufacture.

In addition, in the embodiments of the present disclosure, the first guide rail structure may also include protrusions of other shapes, and the second guide rail structure may also include grooves of other shapes, such as circular protrusions and circular grooves, triangular protrusions and triangular grooves, and the like, which are not limited in the embodiments of the present disclosure.

Optionally, the shape of an opening of the strip-shaped groove and the shape of a protruding end of the strip-shaped protrusion may be similar or the same. For example, the shape of the strip-shaped groove is not completely complementary to that of the strip-shaped protrusion; and the size of the strip-shaped protrusion may be smaller than that of a complementary structure of the strip-shaped groove, such that a certain sliding gap is maintained during the cooperation.

In this way, the corners of both the strip-shaped protrusion and strip-shaped grooves may be chamfered.

Each corner of the strip-shaped protrusion and the strip-shaped groove is chamfered, and a corner formed at an intersection of three edges is also chamfered, such that the strip-shaped protrusion and the strip-shaped groove may be in cooperation more easily. That is, the first guide rail structure 1011 and the second guide rail structure 2011 may be in cooperation more easily, such that a stress during the cooperation is reduced, the service life of the structure is prolonged, and damages caused to the surface of the strip-shaped protrusion or the strip-shaped groove during the cooperation are prevented.

Optionally, the corners of both the strip-shaped protrusion and the strip-shaped groove may are rounded, which may also facilitate the cooperation between the first guide rail structure 1011 and the second guide rail structure 2011 and may reduce a stress during the cooperation, such that the service life of the structure is prolonged.

Optionally, the strip-shaped protrusion may further have a dome which may reduce friction during the plugging in process and may improve robustness of the structure, such that the service life of the structure is prolonged.

In this way, when the first guide rail structure 1011 includes the strip-shaped protrusion, that is, when the strip-shaped protrusion is arranged on the connector 1, the material of the strip-shaped protrusion includes polyterephthalate plastic, and may be the same as the material of the connector 1.

In this way, the length of the second guide rail structure 2011 may be same as that of the substrate layer 201 of the plug 2 in the plugging direction. That is, two tail ends of the second guide rail structure 2011 are open and may not be blocked by the substrate layer 201, such that a sufficiently wide range of relative sliding may be defined between the plug 2 and the jack 101. Thus, the plug 2 may be smoothly plugged into a preset connection position (which may refer to a position where the first terminal and the second terminal may successfully establish an electrical connection) in the jack 101, such that the first terminal and the second terminal 202 are successfully in contact with each other and electrically connected to each other.

Optionally, the length of the strip-shaped protrusion may be qual to or different from the length of the strip-shaped groove. Generally, the length of the strip-shaped protrusion is less than that of the strip-shaped groove, such that the strip-shaped protrusion may be plugged into the strip-shaped groove more easily.

In the second optional implementation, the first guide rail structure 1011 includes the strip-shaped groove, and the second guide rail structure 2011 includes the strip-shaped protrusion. The structures of both the strip-shaped protrusion and the strip-shaped groove are suitable for cooperation with each other. That is, the strip-shaped protrusion of the second guide rail structure 1011 may be plugged into the strip-shaped groove of the first guide rail structure 2011.

Optionally, the shape of the strip-shaped groove is not completely complementary to that of the strip-shaped protrusion; and the size of the strip-shaped protrusion may be smaller than that of a complementary structure of the strip-shaped groove, such that a certain sliding gap is left during the cooperation.

In this way, the corners of both the strip-shaped protrusion and the strip-shaped groove may be chamfered.

Each corner of the strip-shaped protrusion and the strip-shaped groove is chamfered, and a corner formed at an intersection of three edges is also chamfered, such that the strip-shaped protrusion and the strip-shaped groove may be in cooperation more easily. That is, the first guide rail structure 1011 and the second guide rail structure 2011 may cooperate with each other more easily, such that a stress during the cooperation is reduced, the service life of the structure is prolonged, and damages caused to the surface of the strip-shaped protrusion or the strip-shaped groove during the cooperation are prevented.

Optionally, the corners of both the strip-shaped protrusion and the strip-shaped groove may be rounded, which may also facilitate the cooperation between the first guide rail structure 1011 and the second guide rail structure 2011 and may reduce the stress during the cooperation, such that the service life of the structure is prolonged.

In this way, the second guide rail structure 2011 is the strip-shaped protrusion. That is, when the strip-shaped protrusion is arranged on the plug 2, the material of the strip-shaped protrusion includes polyimide, and may be the same as that of the substrate layer 201 in the plug 2.

FIG. 1 shows a schematic structural diagram of the above first alternative guide rail position arrangement. The first guide rail structure 1011 includes two strip-shaped protrusions on the side surfaces of the jack 101, and the second guide rail structure 2011 correspondingly includes strip-shaped grooves on the two side surfaces of the substrate layer 201.

Figure 3:
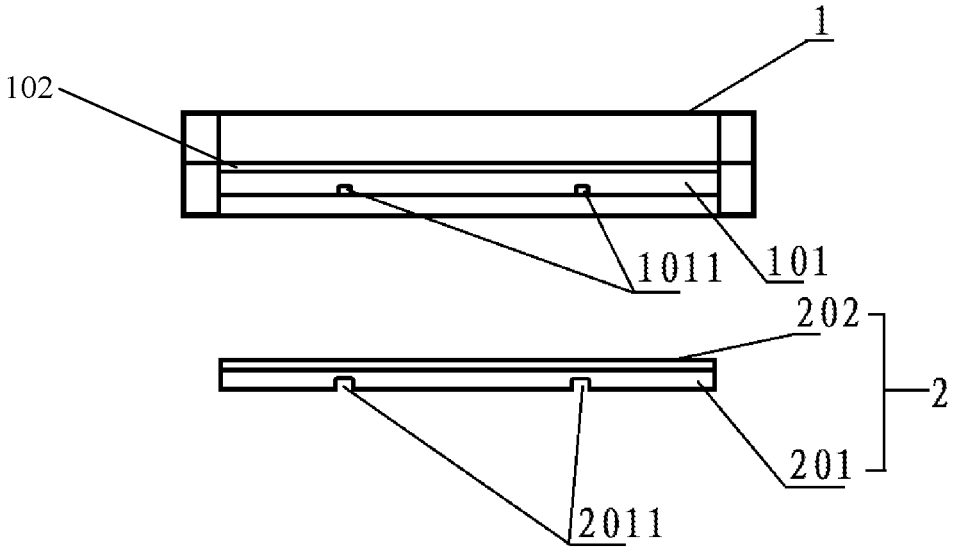
FIGS. 3 and 4 are schematic diagrams of two different guide rail structure arrangements of the plug-in structure according to the embodiment of the present disclosure.
Figure 4:
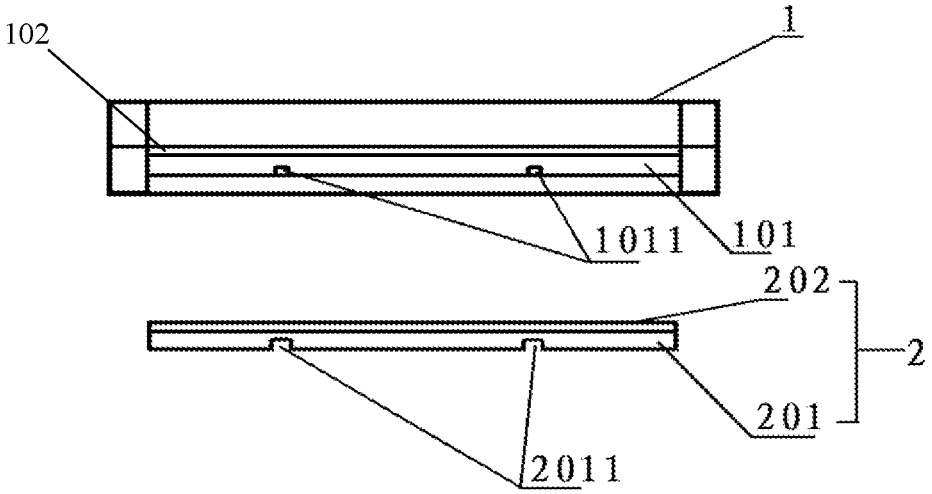

The schematic structural diagrams of the above second alternative guide rail position arrangements may be shown in FIGS. 3 and 4, which show section views of two other plug-in structures according to the embodiments of the present disclosure (the section may be one surface perpendicular to the plugging direction). Here, FIGS. 3 and 4 show a case where the first guide rail structure 1011 includes the strip-shaped protrusion and the second guide rail structure 2011 includes the strip-shaped groove.

As shown in FIG. 3, the first guide rail structure 1011 may include two strip-shaped protrusions disposed on one bottom surface of the jack, and the second guide rail structure may include two strip-shaped grooves disposed on the bottom surface (i.e., the second surface) of the substrate layer 201. The two strip-shaped protrusions and the two strip-shaped grooves may be in cooperation with each other to guide the plug 2 during the plugging of the plug into the jack, such that the plug 2 is plugged into the jack 101 more smoothly.

As shown in FIG. 4, the first guide rail structure 1011 may include one strip-shaped protrusion disposed on one bottom surface of the jack, and the second guide rail structure may include one strip-shaped groove disposed on the bottom surface (i.e., the second surface) of the substrate layer 201. The strip-shaped protrusion and the strip-shaped groove may be in cooperation with each other to guide the plug 2 during the plugging of the plug into the jack, such that the plug 2 is plugged into the jack 101 more smoothly. This structure may also simplify the overall structure and reduce the manufacturing cost.

For the plug-in structures shown in FIGS. 3 and 4, the first guide rail structure may also include protrusions of other shapes, and the second guide rail structure may also include grooves of other shapes, such as circular protrusions and circular grooves, triangular protrusions and triangular grooves, and the like, which are not limited in the embodiments of the present disclosure.

In an optional implementation, the connector 1 further includes a latch configured to fix the plug 2 in the jack 101 of the connector 1 after the first terminal and the second terminal are in successful contact with each other and establish an electrical connection at the preset connection position (which may refer to a position where the first terminal and the second terminal are electrically connected successfully) where the plug 2 has been plugged into the jack 101 of the connector 1, so as to ensure the connection firmness. The fixation of the latch is specifically as follows.

One end of the latch is rotatably arranged on the connector 1, and a snap is arranged at the other end of the latch. When the end with the snap is pressed down, the latch may be fixed on the connector 1 by using the snap, and meanwhile, the plug 2 is fixed in the jack 101 of the connector 1.

In a technical solution, the process of plugging the plug into the connector is generally as follows.

Tweezers are employed to clamp a position on the second flexible printed circuit board proximal to the plug, and the plug is aligned with the jack of the connector. After alignment, the position on the second flexible printed circuit board proximal to the plug is kept to be clamped with the tweezers, and the plug is plugged into the jack of the connector. The tweezers are continuously used to exert a pushing force on the second flexible printed circuit board, such that the plug is plugged into the preset position in the jack of the connector, and the first terminal and the second terminal are in successful contact with each other and establish an electrical connection. In the process of plugging of the plug into the jack of the connector, the tweezers need to generate enough friction force on the second flexible printed circuit board, while this friction force is likely to cause a sharp tweezer head to damage the surface of the second flexible printed circuit board. In addition, during the plugging process, the tweezers are likely to enter the interior of the jack, while the relatively narrow jack may squeeze the tweezer head, which in turn causes the tweezer head to damage the surface of the second flexible printed circuit board, resulting in copper leakage.

Figure 5:
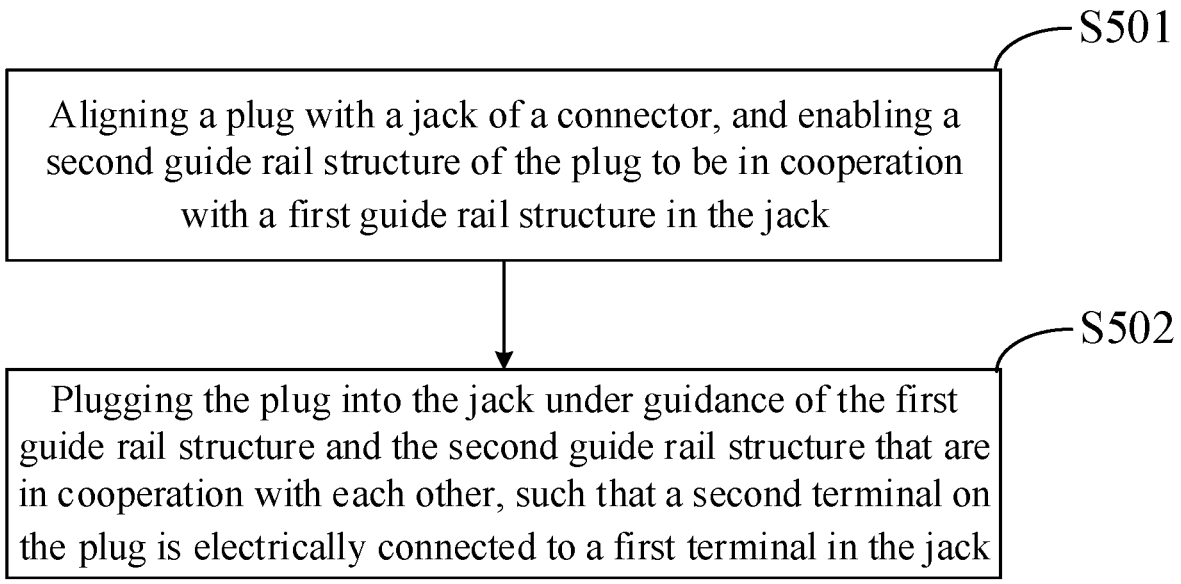
FIG. 5 is a flow chart of a plug-in method according to an embodiment of the present disclosure.

An embodiment of the present disclosure provides a plug-in method. A flow chart of the plug-in method is as shown in FIG. 5. The plug-in method is used in the plug-in structure according to any of the above embodiments, and includes step S501 and step S502.

In step S501, the plug 2 is aligned with the jack 101 of the connector 1, and the second guide rail structure 2011 of the plug 2 and the first guide rail structure 1011 in the jack 101 are enabled to be in cooperation with each other.

Specifically, the operation of aligning the plug 2 with the jack 101 of the connector 1 and enabling the second guide rail structure 2011 of the plug 2 to be in cooperation with the first guide rail structure 1011 in the jack 101 may be performed by an operator by using the tweezers to clamp the position of the second flexible printed circuit board proximal to the plug 2 and moving the plug 2, such that it is only need to apply a small clamping force, without damaging the surface of the second flexible printed circuit board.

In step S502, the plug 2 is plugged into the jack 101 under guidance of the first guide rail structure 1011 and the second guide rail structure 2011 that are in cooperation with each other, such that the second terminal 202 on the plug 2 is electrically connected to the first terminal in the jack 101.

Specifically, after the first guide rail structure 1011 and the second rail 2021 are in cooperation with each other, the plug 2 may slide in the jack 101 of the connector 1 by using the guidance of the first guide rail structure 1011 and the second guide rail structure 2011 that are in cooperation with each other, such that the plug 2 is smoothly plugged into the preset connection position (which may refer to a position where the first terminal and the second terminal are electrically connected to each other successfully) in the jack 101 of the connector 1. In this way, the first terminal and the second terminal are successfully in contact with each other and electrically connected to each other.

Specifically, after the first guide rail structure 1011 and the second rail 2021 are in cooperation with each other, the operator may release the tweezers and directly push the position of the second flexible circuit board proximal to the plug 2 with a relatively small force by using his/her finger. In this way, the plug 2 may be simply pushed into the jack 101 of the connector 1 without no larger clamping force being applied. In this way, damages caused to to an electromagnetic shielding film on the surface of the second flexible circuit board, and the copper leakage are prevented.

An embodiment of the present disclosure further provides a connector, including the connector 1 in the plug-in structure in any of the above embodiments.

The structure of the connector is the same as that of the connector 1 in any of the above embodiments.

An embodiment of the present disclosure further provides a plug. The plug includes the plug 2 in the plug-in structure in any of the above embodiments.

The structure of the plug is the same as that of the plug 2 in any of the above embodiments.

In summary, the plug-in structure according to the embodiment of the present disclosure includes the connector and the plug, wherein the connector is provided with the jack in which the first terminal and the first guide rail structure are arranged, and the first terminal may be electrically connected to the first flexible circuit board. The plug is provided with the second terminal and the second guide rail structure. The second terminal 202 may be electrically connected to the second flexible circuit board. As long as the plug is partially plugged into the connector, the second guide rail structure of the plug may be in cooperation with the first guide rail structure in the jack to guide the plug to continue to be plugged into the jack, such that the plug is smoothly plugged into the jack of the connector, and thus the first flexible circuit board is in communication with the second flexible circuit board. In this way, damages caused by a clamping tool (such as the tweezers) to the flexible circuit boards are prevented.

Described above are only optional embodiments of the present disclosure, and are not intended to limit the present disclosure. Within the spirit and principles of the present disclosure, any modifications, equivalent substitutions, improvements and the like should be embraced by the protective scope defined by the claims appended to the present disclosure.

What is claimed is:

1. A plug-in structure, comprising a connector and a plug; wherein the connector is provided with a jack, a first terminal and a first guide rail structure are provided in the jack, and the first terminal is configured to be electrically connected to a first flexible circuit board; and the plug comprises a substrate layer and a second terminal and a second guide rail structure, which are on the substrate layer, the substrate layer overlaps with the second terminal, a material of the substrate layer comprises polyimide and the substrate layer is configured to increase the thickness and strength of the plug, wherein the second terminal is configured to be electrically connected to a second flexible circuit board, and the second guide rail structure of the plug is in cooperation with the first guide rail structure in the jack to guide the plug to move in the jack, such that the first terminal and the second terminal are electrically connected.

2. The plug-in structure according to claim 1, wherein the first guide rail structure comprises a strip-shaped protrusion, and the second guide rail structure comprises a strip-shaped groove.

3. The plug-in structure according to claim 1, wherein the first guide rail structure comprises a strip-shaped groove, and the second guide rail structure comprises a strip-shaped protrusion.

4. The plug-in structure according to claim 2, wherein corners of both the strip-shaped protrusion and the strip-shaped groove are chamfered.

5. The plug-in structure according to claim 2, wherein corners of both the strip-shaped protrusion and the strip-shaped groove are rounded.

6. The plug-in structure according to claim 1, wherein the jack is a square hole enclosed by two opposite side surfaces and two opposite bottom surfaces.

7. The plug-in structure according to claim 6, wherein the first guide rail structure is disposed on the two side surfaces.

8. The plug-in structure according to claim 7, wherein the substrate layer is enclosed by a first surface and a second surface opposite to each other as well as a side surface connected to both the first surface and the second surface; and wherein the second terminal is disposed on the first surface; and the second guide rail structure is disposed on the side surface.

9. The plug-in structure according to claim 6, wherein the first guide rail structure is disposed on one of the two bottom surfaces.

10. The plug-in structure according to claim 9, wherein the substrate layer is enclosed by a first surface and a second surface opposite to each other as well as a side surface connected to both the first surface and the second surface; and wherein the second terminal is disposed on the first surface; and the second guide rail structure is disposed on the second surface.

11. The plug-in structure according to claim 2, wherein a material of the strip-shaped protrusion comprises polyterephthalate plastic.

12. The plug-in structure according to claim 1, wherein the first guide rail structure comprises a strip-shaped protrusion, the second guide rail structure comprises a strip-shaped groove, corners of both the strip-shaped protrusion and the strip-shaped groove are rounded, and a material of the strip-shaped protrusion comprises polyterephthalate plastic;

the jack is a square hole enclosed by two opposite side surfaces and two opposite bottom surfaces, and the first guide rail structure is disposed on the two side surfaces; and the substrate layer is enclosed by a first surface and a second surface opposite to each other as well as a side surface connected to both the first surface and the second surface; the second terminal is disposed on the first surface, the second guide rail structure is disposed on the side surface.

13. A plug-in method of the plug-in structure according to claim 1, comprising:

aligning the plug with the jack of the connector, and enabling the second guide rail structure of the plug to be in cooperation with the first guide rail structure in the jack; and plugging the plug into the jack under guidance of the first guide rail structure and the second guide rail structure that are in cooperation with each other, such that the second terminal on the plug is electrically connected to the first terminal in the jack.

14. A connector, wherein the connector comprises the connector in the plug-in structure according to claim 1.

15. The connector according to claim 14, wherein the jack is a square hole enclosed by two opposite side surfaces and two opposite bottom surfaces, and the first guide rail structure is disposed on the two side surfaces.

16. A plug, wherein the plug comprises the plug in the plug-in structure according to claim 1.

17. The plug according to claim 16, wherein the substrate layer is enclosed by a first surface and a second surface opposite to each other as well as a side surface connected to both the first surface and the second surface; the second terminal is disposed on the first surface; and the second guide rail structure is disposed on the side surface.

18. The plug according to claim 16, wherein the substrate layer is enclosed by a first surface and a second surface opposite to each other as well as a side surface connected to both the first surface and the second surface; the second terminal is disposed on the first surface; and the second guide rail structure is disposed on the second surface.

* * * * *